US010624465B2

(12) United States Patent
Dahlin et al.

(10) Patent No.: US 10,624,465 B2
(45) Date of Patent: Apr. 21, 2020

(54) MATTRESS ARRANGEMENT, SUCH AS A BED, HAVING ADJUSTABLE FIRMNESS

(71) Applicant: Stjernfjädrar AB, Herrljunga (SE)

(72) Inventors: Johan Dahlin, Grastorp (SE); Bengt Hager, Vinninga (SE)

(73) Assignee: STARSPRINGS AB, Herrljunga (SE)

( * ) Notice: Subject to any disclaimer, the term of this patent is extended or adjusted under 35 U.S.C. 154(b) by 641 days.

(21) Appl. No.: 15/122,809

(22) PCT Filed: Mar. 26, 2015

(86) PCT No.: PCT/EP2015/056603
§ 371 (c)(1),
(2) Date: Aug. 31, 2016

(87) PCT Pub. No.: WO2015/144836
PCT Pub. Date: Oct. 1, 2015

(65) Prior Publication Data

US 2017/0086597 A1 Mar. 30, 2017

(30) Foreign Application Priority Data

Mar. 26, 2014 (EP) ..... 14161718
Jan. 19, 2015 (BR) ..... 10 2015 001231-4

(51) Int. Cl.
*A47C 27/06* (2006.01)
*A47C 23/043* (2006.01)
(Continued)

(52) U.S. Cl.
CPC ..... *A47C 27/061* (2013.01); *A47C 23/0435* (2013.01); *A47C 23/34* (2013.01);
(Continued)

(58) Field of Classification Search
CPC ... A47C 23/0435; A47C 23/34; A47C 27/001; A47C 27/061; A47C 27/064;
(Continued)

(56) References Cited

U.S. PATENT DOCUMENTS 2,822,032 A * 2/1958 Palmer ..... B60N 2/72 267/89
3,252,170 A 5/1966 Frye
(Continued)

FOREIGN PATENT DOCUMENTS

AU 551300 B2 4/1986
CN 101835409 A 9/2010
(Continued)

OTHER PUBLICATIONS

Russian Office Action and Search Report dated Jul. 20, 2018 issued in corresponding Russian Application No. 2016135341/12 (English translation).
(Continued)

*Primary Examiner* — Nicholas F Polito
(74) *Attorney, Agent, or Firm* — Harness, Dickey & Pierce, P.L.C.

(57) ABSTRACT

A mattress arrangement, such as a bed arrangement (1), having adjustable firmness is disclosed. The mattress arrangement comprises an upper mattress (3) and a lower mattress (4) being arranged beneath said upper mattress (3). At least one side (41) of the lower mattress (4) is moveable in relation to an opposite side (42) of the lower mattress (4), the lower mattress (4) thereby being expandable into an expanded state, having a lower firmness, and compressible into a contracted state, having a higher firmness. A support layer (6) is arranged between the upper mattress (3) and the lower mattress (4), to partly support the upper mattress (3), and arranged overlying the at least one moveable side (41)
(Continued)

of the lower mattress (4). Hereby, at least one compartment is formed beneath the upper mattress (3), wherein the compartment(s) is at least partly empty when the lower mattress (4) is in the contracted state and at least partly filled when the lower mattress (4) is in the expanded state.

11 Claims, 14 Drawing Sheets

(51) Int. Cl.
*A47C 23/34* (2006.01)
*A47C 27/00* (2006.01)
*A47C 27/07* (2006.01)

(52) U.S. Cl.
CPC ..... *A47C 27/001* (2013.01); *A47C 27/064* (2013.01); *A47C 27/066* (2013.01); *A47C 27/07* (2013.01)

(58) Field of Classification Search
CPC ..... A47C 27/066; A47C 27/07; A47C 27/15; A47C 7/345
See application file for complete search history.

(56) References Cited

U.S. PATENT DOCUMENTS

| | | | | |
|---|---|---|---|---|
| 3,273,877 | A * | 9/1966 | Geller | B60N 2/72 267/89 |
| 3,340,548 | A | 9/1967 | Janapol | |
| 3,739,409 | A * | 6/1973 | Johnson | A47C 27/061 5/697 |
| 4,222,137 | A | 9/1980 | Usami | |
| 5,105,488 | A * | 4/1992 | Hutchinson | A47C 23/047 5/614 |
| 5,113,539 | A * | 5/1992 | Strell | A47C 23/047 297/284.3 |
| 5,469,590 | A * | 11/1995 | Simon | A47C 27/04 267/287 |
| 5,987,678 | A | 11/1999 | Ayers | |
| 7,048,263 | B2 | 5/2006 | Ahlqvist et al. | |
| 8,176,589 | B2 | 5/2012 | Stjerna et al. | |
| 10,334,957 | B2 * | 7/2019 | Edling | A47C 23/0435 |
| 2006/0253994 | A1 | 11/2006 | Spinks et al. | |
| 2007/0124865 | A1 | 6/2007 | Stjerna | |
| 2010/0317930 | A1 * | 12/2010 | Oexman | A47C 31/123 600/300 |
| 2010/0325810 | A1 * | 12/2010 | Dahlin | B60N 2/24 5/716 |
| 2011/0004371 | A1 * | 1/2011 | Bullard | A47C 7/285 701/36 |
| 2011/0258772 | A1 | 10/2011 | Verschuere et al. | |
| 2012/0042454 | A1 * | 2/2012 | Viberg | A47C 23/0435 5/727 |

FOREIGN PATENT DOCUMENTS

| | | | |
|---|---|---|---|
| CN | 102006803 | A | 4/2011 |
| DE | 3738272 | A1 | 5/1989 |
| EP | 2042058 | A2 | 4/2009 |
| EP | 2245967 | A1 | 11/2010 |
| FR | 2750584 | A1 | 1/1998 |
| JP | S5521932 | A | 2/1980 |
| JP | S6421660 | U | 2/1989 |
| JP | H10509367 | A | 9/1998 |
| RU | 119217 | U1 | 8/2012 |
| WO | WO-9965366 | A1 | 12/1999 |
| WO | WO-2009/054798 | A1 | 4/2009 |
| WO | WO-2009/102361 | A1 | 8/2009 |
| WO | WO-2009120270 | A2 | 10/2009 |

OTHER PUBLICATIONS

European Office Action dated Jun. 28, 2018 issued in corresponding European Application No. 14161718.3.
European Office Action dated Feb. 28, 2017 issued in corresponding European Application No. 14161718.3.
Japanese Office Action dated Jan. 29, 2019 issued in corresponding Japanese Application No. 2016-558361 (with English translation).
Chinese Office Action dated May 30, 2018 in corresponding Chinese Application No. 201580014591.0.
International Search Report PCT/ISA/210 for International Application No. PCT/EP2015/056603 dated May 19, 2015.
Chinese Office Action dated Apr. 24, 2019 issued in corresponding Chinese Application No. 201580014591.0, no English translation is provided.

* cited by examiner

MATTRESS ARRANGEMENT, SUCH AS A BED, HAVING ADJUSTABLE FIRMNESS

CROSS-REFERENCE TO RELATED APPLICATIONS

This application is a national phase under 35 U.S.C. § 371 of PCT International Application No. PCT/EP2015/056603 which has an International filing date of Mar. 26, 2015, which claims priority to European Application No. 14161718.3, filed Mar. 26, 2014 and Brazilian Application No. 10 2015 001231-4, filed Jan. 19, 2015, the entire contents of each of which are hereby incorporated by reference.

FIELD OF THE INVENTION

The present invention relates to a mattress arrangement, such as a bed arrangement, having adjustable firmness. It also relates to a pocket spring mattress useable in such a mattress arrangement, and to a method for controlling such a mattress arrangement.

BACKGROUND OF THE INVENTION

In mattress arrangements, such as in a bed arrangement or other seating or furniture arrangements, a support is provided to act on the weight or part of the weight of a user, wherein the bed distributes the weight from the body of the user over a part of a surface of the device. Depending on how the bed distributes the weight of the user, the bed will appear as being either soft or firm. The degree of firmness of such a bed is dependent on the properties of the elastic elements, such as the spring constant, and how the elastic members have been mounted in the bed, such as the degree of clamping or pre-tensioning. Thus, the firmness of the bed is normally set at the manufacturing of the device.

However, different persons wish and require different firmness. Further, different body parts may require different firmness.

It is known to provide bed arrangements with variable firmness. By inducing deformation to the elastic members to different degrees, the firmness of the device is adjustable. The deformation member has the ability to deform the elastic member independently from the deformation of the elastic member induced by the being. This means that the firmness of the bed is adjustable during initialization, according to the wishes of the user. It is also possible to compensate the firmness of the device for possible changes in the elastic properties of the elastic arrangement over time. Such known solutions are e.g. disclosed in EP 2 245 967 and WO 2009/120270.

Further, it is known to provide variation in firmness of a mattress by arranging coil springs on support plates having variable height. The height of the support plates may be controlled by rotatable elements arranged under the support plates, and having an off-centre rotation axis. Hereby, by rotation of the rotatable elements, the plates assume various height positions. Such firmness adjustment means are e.g. discussed in U.S. Pat. No. 3,340,548 and US 2011/0258772. It is also known to use a similar arrangement with support plates having variable height where the height of the support plates may be controlled by displacement members in the form of linear motors, jacks, and other types of lifting mechanism. Such firmness adjustment means are e.g. discussed in AU 55 13 00, U.S. Pat. No. 4,222,137, US 2006/0253994, WO 99/65366 and EP 2 245 967.

However, common problems with these previously known bed arrangements with variable firmness are that they are relatively complex, heavy and costly to produce. Further, these known bed arrangements are also often relatively difficult and cumbersome to use. Further, even though these known bed arrangements provide a certain degree of adjustability, this is often inadequate for the users' needs.

Another approach is presented in U.S. Pat. No. 8,176,589, by the same applicant as in the present application, in which the bed has a variable width, and the mattress is arranged to be expanded/contracted together with the expansion/contraction of the bed frame. However, a significant drawback of this approach is that the size of the bed varies significantly.

It is therefore still a need for a mattress arrangement, and in particular a bed arrangement, with adjustable firmness which alleviates the above-discussed problems.

SUMMARY OF THE INVENTION

It is therefore an object of the present invention to at least partly overcome these problems, and to provide an improved mattress arrangement.

These, and other objects that will be apparent from the following, are achieved by a mattress arrangement, a pocket spring mattress, and a method for controlling a mattress arrangement, according to the appended claims.

According to a first aspect of the invention there is provided a mattress arrangement, such as a bed arrangement, comprising:

an upper mattress;

a lower mattress being arranged beneath said upper mattress;

a support layer arranged between the upper mattress and the lower mattress, to partly support the upper mattress;

wherein at least one side of the lower mattress is moveable in relation to an opposite side of the lower mattress, the lower mattress thereby being expandable into an expanded state, having a lower firmness, and compressible into a contracted state, having a higher firmness; and wherein said support layer is arranged overlying said at least one moveable side of the lower mattress, thereby forming at least one compartment beneath the upper mattress, said compartment(s) being at least partly empty when the lower mattress is in the contracted state and at least partly filled when the lower mattress is in the expanded state.

The mattress arrangement may be a bed arrangement, but other types of seating or furniture arrangements are also feasible. In particular, the mattress arrangement comprises a mattresses, e.g. in the form of a bed mattress, a cushion or the like, for accommodating the weight of a user. Such mattresses may e.g. be used in seats for all sorts of vehicles, upholstered furniture, bed arrangements and the like.

The support layer may be connected to a bed frame or the like, on which the lower mattress rests. However, the support layer may also be connected to side supports being connected to a base of the lower mattress, a base of the bed, or the like. The support layer may also be connected to a frame arranged between the upper and lower mattresses, such as a frame encircling the perimeter of the lower side of the upper mattress. In this case, the support layer may form an integral part with the upper or lower mattress.

Further mattresses, padding layers, etc may also be provided. Further, the whole mattress arrangement may also be commonly enclosed in a cover fabric.

The support layer is preferably inelastic, and may be formed as a rigid structure, such as a plate, a lattice, bars etc.

It may also be formed by pliable/flexible and preferably non-elastic elements, such as a fabric, flexible bands, cords, or the like. However, the support layer may also be formed by pliable/flexible and elastic elements, such as fabric, bands, cords or the like made of elastic material.

The support layer is arranged to overlie the displaceable end(s) of the lower mattress, and have an extension so that it provides support for the upper layer over the empty space(s) formed when the lower mattress is compressed into the contracted state. However, the support layer only partly supports the upper mattress, which means that the support layer should not cover and support the whole lower surface of the upper mattress. A greater part of the lower surface of the upper mattress remains unsupported by the support layer, and this part of the upper mattress is instead supported directly by the lower mattress. Thus, the support layer provides a support only for a limited part of the upper mattress, or for limited parts, in case several different areas is to be supported. Consequently, the support layer(s) preferably each has a horizontal dimension being equal, or nearly equal, to the horizontal dimension of the upper mattress in one direction, corresponding to a direction perpendicular to the direction in which the lower mattress is contracted, but a horizontal dimension being much smaller than the horizontal dimension of the upper mattress in another direction, corresponding to the direction in which the lower mattress is contracted. Preferably, the horizontal extension of the support layer in this latter direction is in the range of 5-40% of the corresponding dimension of the upper mattress, and preferably in the range of 10-30%.

The contraction of the lower mattress preferably occurs in the length direction of the mattress, but may alternatively or additionally occur in the width direction.

At positions where the upper surface is not supported by the support layer, the upper mattress is supported by the lower mattress. When the firmness of the lower mattress decreases, i.e. when it is expanded, this allows the upper mattress to sink more easily into the lower mattress, thereby increasing the softness of the bed/seat. When the firmness of the lower mattress is increased, i.e. when it is contracted, this provides increased resistance for the upper mattress to sink into the lower mattress, resulting in a firmer mattress arrangement.

Since the support layer is arranged overlying the at least one moveable side of the lower mattress, thereby forming at least one compartment beneath the upper mattress, the moveable side is free to move in and out of this compartment. Hence, the compartment is at least partly empty when the lower mattress is in the contracted state and at least partly filled when the lower mattress is in the expanded state The sleeping/sitting/resting experience, and what is considered comfortable and not, varies greatly from person to person. Further, a user often may find it more comfortable to have a softer mattress when using one lying position, such as on the stomach, i.e. in a prone position, or on the side, than when resting in other sleeping positions, such as on the back, i.e. in supine position. The present invention provides an efficient, yet relatively simple and cost-efficient, way of varying the mattress properties in dependence of the user's wishes, and e.g. based on the choice of lying position. It has been found that this greatly improves the sleeping and resting experience, which provides better resting and sleeping quality. Improved sleep and rest also improves the health of the user, and overall leads to an improved quality of life.

Prior to the present invention, mattresses and seats/beds with adjustable properties were known to be complex, heavy and costly, and also difficult and cumbersome to use. In contrast, the present invention provides a mattress arrangement, such as a bed arrangement, with adjustable properties which weighs very little, is relatively simple and cost-efficient to produce, which is easy to operate for the user. The mattress arrangement also lends itself very well for automated or semi-automated manufacturing.

Still further, the mattress arrangement of the present invention provides fixed outer dimensions, since the contraction of the lower mattress occurs underneath the upper mattress, and may easily be concealed to the user. Thus, the overall size and appearance of the mattress arrangement remains the same, regardless of the firmness settings being used.

It has been found that by this variation of the extension of the lower mattress, a wide degree of different firmness settings for the mattress arrangement may be obtained. The firmness is also controllable in a very precise and predictable way.

The part of the mattress arrangement in which the upper mattress overlies the support layer maintains the same firmness all the time. However, preferably the support layer is arranged in a part of the mattress arrangement which is intended to carry only a low or moderate, such as in the foot end of the mattress arrangement. In this area, there is normally anyway no need for firmness adjustments. Further, in a bed, this part of the mattress arrangement is often used also for sitting, and the increased stability provided by the support layer improves the sitting comfort. Additionally or alternatively, the support layer may be arranged along the long sides of the bed arrangement. Again, this would not impair the sleeping comfort, since the outer edges are normally not used when sleeping. On the contrary, the increased stability towards the edges may often be beneficial, since it again improves the comfort when sitting on the side of the mattress arrangement, and also lowers the risk of accidentally falling out of the bed. Arrangement of the support layer along one or both long sides of the mattress arrangement would also be advantageous when using the mattress arrangement in sofas, davenports and the like. Still further, in case the support layer is made of a somewhat elastic material, the support layer in itself will provide some resilience.

Preferably, the lower mattress has a variable extension in at least a length direction of the mattress. Further, it is preferred that at least a side arranged at a foot-end of the lower mattress is moveable in relation to a side arranged at a head end of the lower mattress. In this case, the side arranged at the head end of the lower mattress is preferably fixed, and preferably at a position corresponding with the side of the upper mattress.

Preferably, the lower mattress in its expanded state has outer dimensions corresponding to the outer dimensions of the upper mattress. Hereby, the lower mattress is used to its maximum, and at the same time, the overall horizontal dimensions of the mattress are only governed by the size of the upper mattress.

The lower mattress may further assume at least one, and preferably a plurality, of intermediate states, between the expanded state and the contracted state. In a preferred embodiment, the lower mattress is continuously controllable to be set in any intermediate state between the expanded state and the contracted state.

The upper mattress may be of various types, such as having inflatable elements, comprising resilient foam elements, resilient rubber, and the like. However, preferably the upper mattress comprises a plurality of coil springs, and preferably coil springs individually arranged in separate pockets of a cover material, to define a pocket spring mattress. The upper mattress may be of any thickness. The upper mattress may in some embodiments be relatively thin, such as having a thickness of only a few centimeters. However, in other embodiments, the upper mattress may be relatively thick, such as having a thickness exceeding a decimeter. In some embodiments, the upper mattress may have essentially the same thickness as the lower mattress. However, in other embodiments the upper mattress may have a lower or much lower thickness than the lower mattress.

The lower mattress may also be of various types. The lower mattress may be of the same type as the upper mattress, or of a different type.

Preferably, the lower mattress is a pocket spring mattress, comprising a plurality of coil springs arranged in pockets. Most preferably, the pocket spring mattress comprises a plurality of parallel strings interconnected side by side, each string comprising a plurality of continuous casings and each casing comprising a coil spring, wherein expansion of the mattress into the expanded state occurs in a least one of a direction being parallel to the strings and a direction being perpendicular to the strings. Mattresses of these types are per se known. One mattress type which is suitable for use in connection with the present invention is the one disclosed in U.S. Pat. No. 8,176,589, by the same applicant, which relates to a pocket spring mattress in which a plurality of stretch openings are formed in the cover material forming the pockets, allowing the strings to be separated from each other. This document is hereby incorporated by reference. Another mattress type which is also suitable for use in connection with the present invention is the one disclosed in U.S. Pat. No. 7,048,263, also by the same applicant, which relates to a pocket spring mattress in which a separation distance is formed between adjacent springs/pockets within each string, allowing the mattress to be expanded and contracted in the direction of the strings. This document is hereby also incorporated by reference. Still another example of a mattress type which is suitable for use in connection with the present invention is the one disclosed in US 2007/124865, also by the same applicant, which relates to a pocket spring mattress in which a separation distance is formed between adjacent springs/pockets within each string, and wherein a slit opening is provided within each separation, further improving the capability of the mattress to be expanded and contracted in the direction of the strings. This document is hereby also incorporated by reference.

The lower mattress further preferably comprises at least one elastic element extending between said moveable side and said opposite side of the lower mattress, wherein the at least one elastic element is arranged to provide a contraction force to bring the lower mattress to the contracted state. Hereby, the lower mattress will resume a contracted state when no exterior force is applied. This simplifies operation of the mattress. Further, this ensures that the distribution of springs in the lower mattress remains uniform also in every intermediate state, between the expanded state and the contracted state. The elastic element may e.g. a band, string, cord or the like of an elastic material. Preferably, a plurality of elastic elements is provided, being distributed over or within the lower mattress. Further, it is preferred that each elastic element is connected to the lower mattress at a plurality of distributed connection points. In case of a pocket spring mattress, it is preferred that each elastic element is connected to a plurality of pockets, and preferably to each pocket it is in contact with.

The elastic element(s) may be arranged on the top surface of the lower mattress, on the lower surface of the lower mattress, at one or several sides of the lower mattress, integrated within the lower mattress, or any combination thereof. In a pocket spring mattress, at least some of the elastic elements may extend between adjacent rows/strings of pocketed springs.

The above-discussed elastic elements are arranged on or integrated in the lower mattress, and are used to provide a contraction of the mattress, to bring it into the contracted state. Thus, for operation of such a mattress, a counterforce is provided, e.g. by a pushing or pulling arrangement, for expanding the mattress and bringing the mattress to an expanded state, or an intermediate state between the contracted state and the expanded state. By releasing the counterforce, the lower mattress is automatically contracted and brought back to a contracted state, being the resting or default state.

However, alternatively resilient elements, such as springs, may instead be arranged to automatically bring the lower mattress into an expanded state, in which case the counterforce should instead be provided to bring the lower mattress into a more contracted state, and whereby a release of the counterforce instead brings the lower mattress back to an expanded resting or default state.

Further, the mattress arrangement preferably comprises a pulling or pushing arrangement connected to the at least one moveable side, to provide a pulling or pushing force to bring the lower mattress to the expanded state. The same or other pushing or pulling arrangement may also be used to bring the lower mattress to the contracted state, in case this is not solved automatically, e.g. by means of above-discussed elastic elements. The pulling or pushing arrangement may be one or several ropes, strings or the like connected to a side of the lower mattress or within the lower mattress. Such an arrangement is very cost efficient, and is in particular suitable for manual operation. The ropes/strings may e.g. be locked in a suitable pulled out position by a locking arrangement, be tied together, or in any other way secured. However, the ropes/strings may also be operated by an electric motor or the like. Further, the moveable side of the lower mattress may be connected to a rigid pulling or pushing element, which may be displaced automatically, by an electric motor or the like, or manually, by a screw arrangement or the like. For example, a lead screw or translation screw may be used. A knob, wheel or any other type of handle may then be manually rotated, thereby rotating the screw, resulting in a corresponding displacement of the rigid pulling element.

The mattress arrangement further preferably comprises a frame arranged to at least partly accommodate the lower mattress, wherein the support layer is connected to the frame. The frame may also optionally be arranged to accommodate, partly or wholly, the upper mattress. The frame is preferably relatively rigid, and can e.g. be made of wood, plastic or metal.

According to another aspect of the invention, there is provided a pocket spring mattress comprising a plurality of parallel strings interconnected side by side, each string comprising a plurality of continuous casings and each casing comprising a coil spring, wherein the mattress further comprises at least one elastic element extending between two opposite sides of the mattress, said at least one elastic element being arranged to provide a contraction force to bring said opposite sides towards each other.

By means of this additional aspect of the invention, similar objects and advantages as discussed above in relation to the first aspect of the invention are obtainable.

The pocket spring mattress preferably comprises a plurality of parallel elastic elements are provided, said elastic elements being separated from each other and distributed over the length or width of the pocket spring mattress.

According to still another aspect of the invention, there is provided a method for adaptation of the firmness of a mattress arrangement, comprising the steps:

providing an upper mattress;

providing a lower mattress being arranged beneath said upper mattress, wherein at least one side of the lower mattress is moveable in relation to an opposite side of the lower mattress, the lower mattress thereby being expandable into an expanded state, having a lower firmness, and compressible into a contracted state, having a higher firmness;

providing a support layer arranged between the upper mattress and the lower mattress, and overlying said at least one moveable side of the lower mattress, to partly support the upper mattress; and controlling the firmness of the mattress by moving said at least one moveable side.

By means of this additional aspect of the invention, similar objects and advantages as discussed above in relation to the first aspect of the invention are obtainable.

BRIEF DESCRIPTION OF THE DRAWINGS

These and other aspects of the present invention will now be described in more detail, with reference to the appended drawings showing currently preferred embodiments of the invention.

FIG. 7*b* illustrates a contracted state;

DETAILED DESCRIPTION

In the following, the invention will be exemplified by means of bed arrangements. However it is to be acknowledged by the skilled reader that the same principles and functions may also be used in other types of mattress arrangements using mattresses, e.g. in the form of a bed mattress, a cushion or the like, such as seats for all sorts of vehicles, upholstered furniture, and the like. Accordingly, when reference in the following is made to a bed or bed arrangement, it is to be understood that this may also be used in other types of mattress arrangements, and in particular other types of furniture arrangements.

Figure 1A:
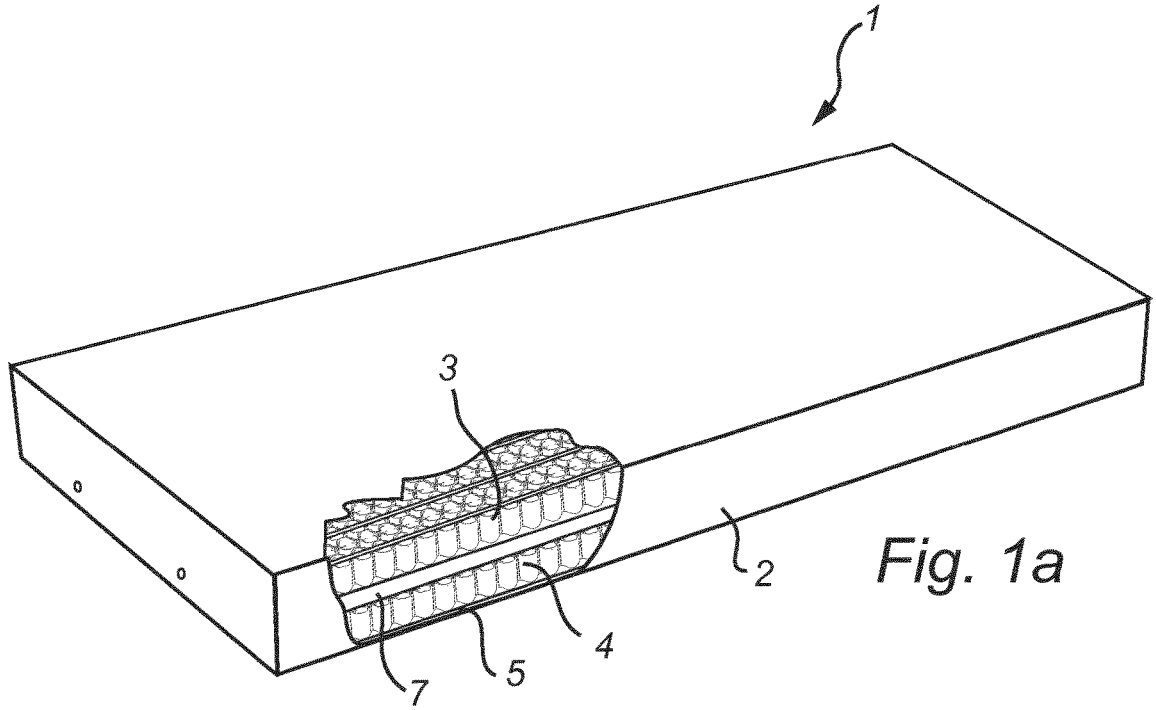
FIG. 1 *a-c* show a schematic perspective view of an embodiment of a bed arrangement according to the present invention, where FIG. 1 *a* shows the bed arrangement with a part of the bed arrangement being shown in cross-section, FIG. 1*b* show the bed arrangement in a schematic cross-section, where the lower mattress is in an expanded state, and FIG. 1*c* show the bed arrangement in a schematic cross-section, where the lower mattress is in a contracted state.

A bed arrangement 1 having adjustable firmness according to a first embodiment of the invention is shown schematically in FIG. 1*a*. The bed arrangement is enclosed in a cover 2, but in a cut-out section in the middle the interior of the bed arrangement is visible. The bed arrangement comprises an upper mattress 3, a lower mattress 4, and a frame 5. A further padding layer 7 or the like may be provided between the upper and lower mattress.

Figure 1B:
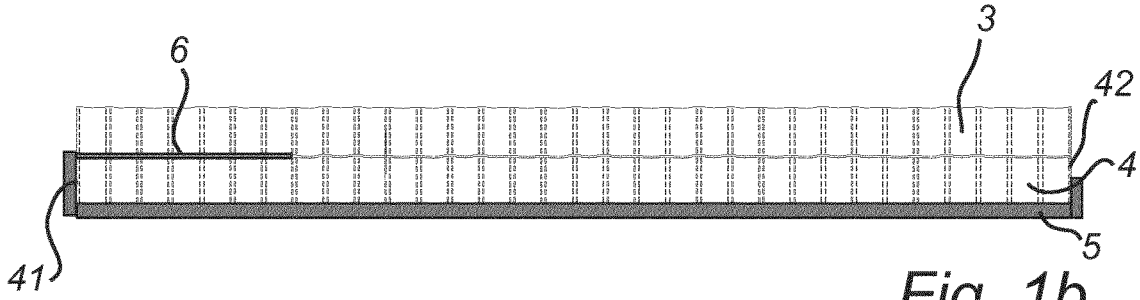
Figure 1C:
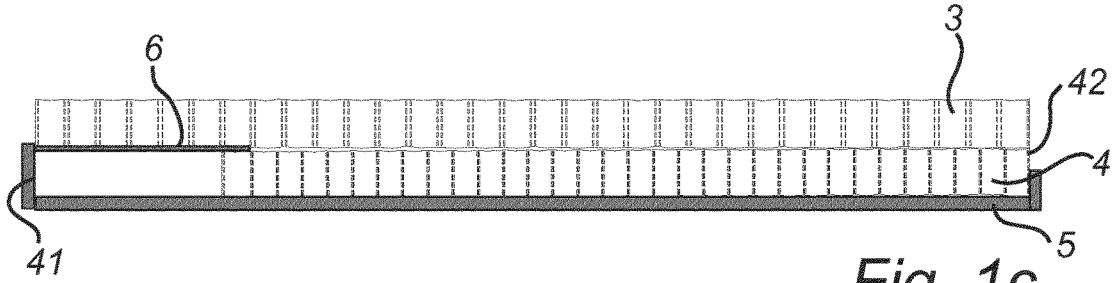

In the cross-sectional views of FIGS. 1*b* and 1*c*, a support layer 6 is further illustrated, providing partly a support for the upper mattress at an end of the bed arrangement, such as the foot end. The support layer may be connected to a bed frame or the like, on which the lower mattress rests. However, as will be further explained in the following, the support layer may also be connected to side supports being connected to a base of the lower mattress, a base of the bed, or the like. The support layer may also be connected to a frame arranged between the upper and lower mattresses, such as a frame encircling the perimeter of the lower side of the upper mattress. In this case, the support layer may form an integral part with the upper or lower mattress.

The support layer 6 is preferably inelastic, and may be form as a rigid structure, such as a plate, a lattice, bars etc. It may also be formed by pliable/flexible and preferably non-elastic elements, such as a fabric, flexible bands, cords, or the like. In the embodiment of FIG. 1, a plate like structure is used. However, elastic elements may also be used to form the support layer.

The support layer is arranged to overlie the displaceable end(s) of the lower mattress, and have an extension so that it provides support for the upper layer over the empty space(s) formed when the lower mattress is compressed into the contracted state. The support layer has a width dimension being equal, or nearly equal, to the width dimension of the upper mattress, and a length dimension being much smaller than the length dimension of the upper mattress.

The lower mattress 4 has a moveable end 41 arranged underneath the support layer 6, and the opposite end 42 is fixed, and aligned with the corresponding end of the upper mattress 3.

The support layer forms a compartment beneath the upper mattress for receiving the moveable side 41 of the lower mattress, in which the lower mattress is free to move. Hence, in an expanded state, providing lower firmness, the compartment is filled by the lower mattress, as illustrated in FIG. 1*b*, whereas in a contracted state, providing greater firmness, the compartment is at least partly empty, as illustrated in FIG. 1*c*.

The support layer may be held in place in various ways, as will be exemplified in the following.

Figure 2:
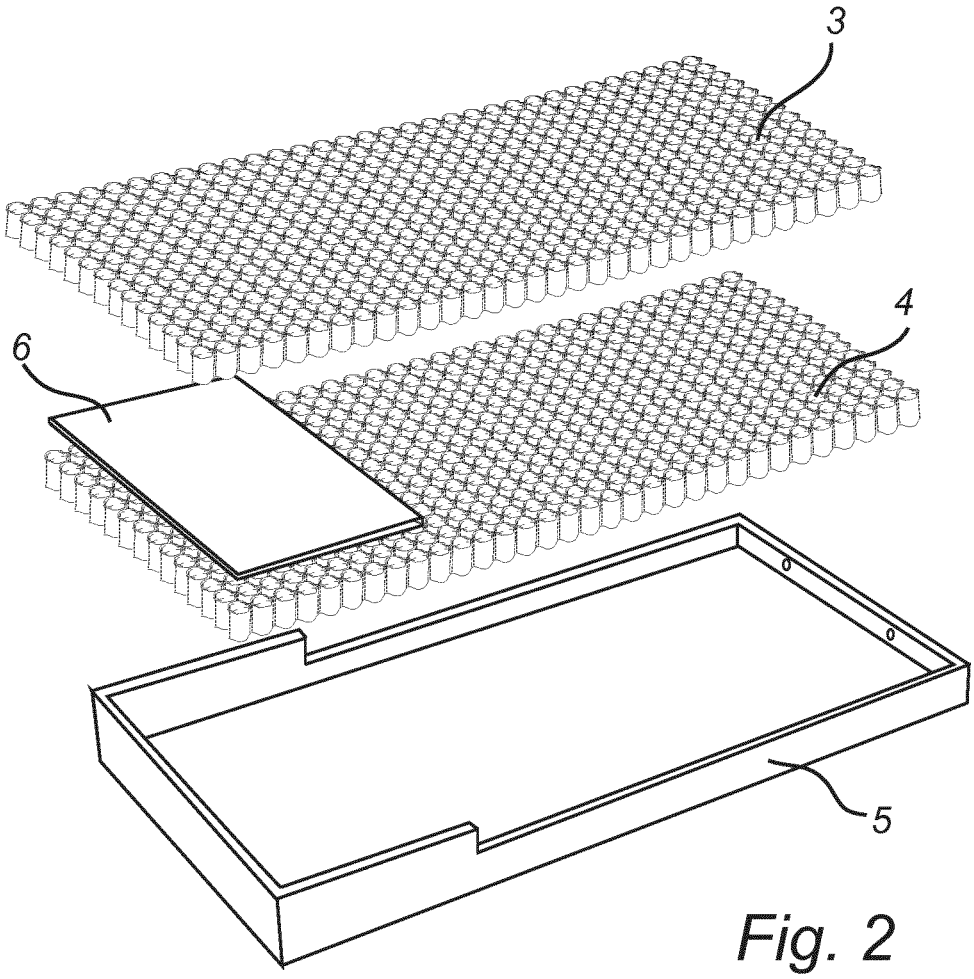
FIG. 2 shows a schematic exploded perspective view of a bed arrangement according to another embodiment of the present invention.

In one embodiment, shown in an exploded view in FIG. 2, the bed frame 5 is arranged to extend up over the sides of the lower mattress 4, at least in one end of the mattress. This end is preferably the foot end of the bed arrangement. The support layer may be connected to the bed frame by means of nails, screws, adhesive or any other suitable fastener, thereby providing a fixed support of this part of the upper mattress 3, and allowing the lower mattress to move in and out from the compartment hereby formed beneath the upper mattress.

Figure 3:
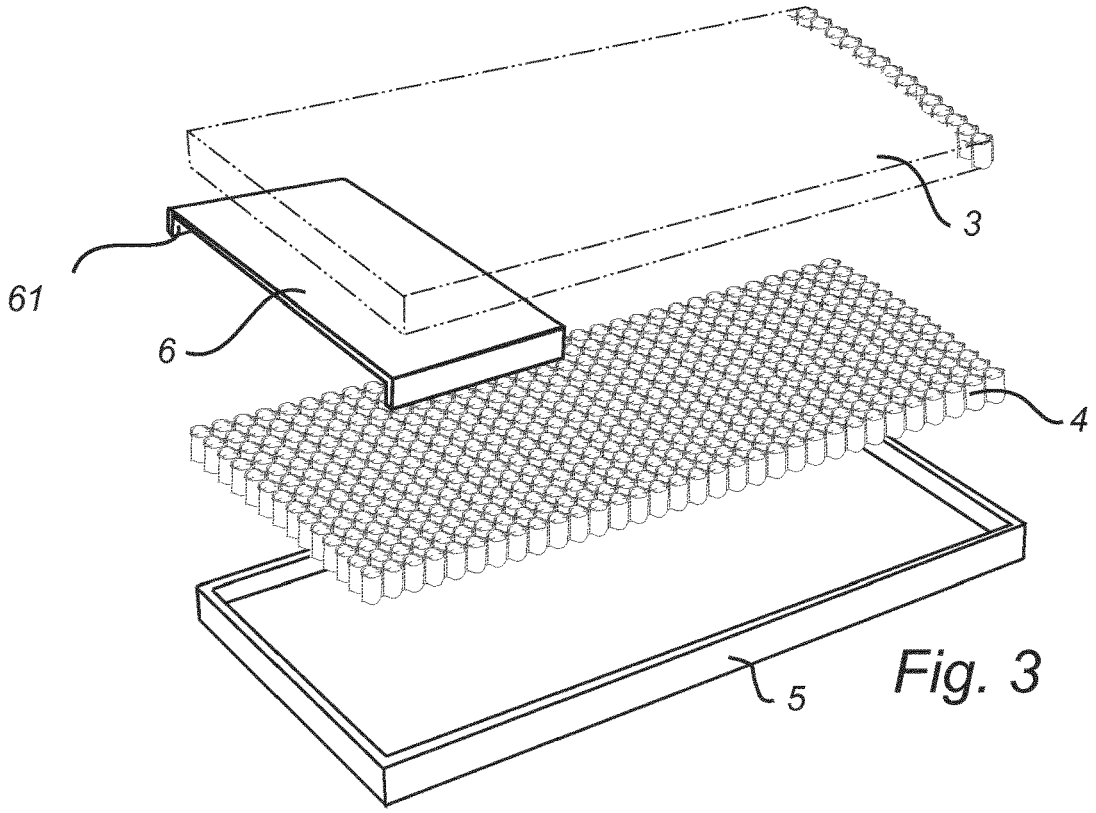
FIG. 3 shows a schematic exploded perspective view of a bed arrangement according to another embodiment of the present invention.

In another embodiment, illustrated in FIG. 3, the support layer is attached to or integrated with supporting sides 61, such as side walls, rods or the like. These may be connected to a frame 5' arranged beneath the lower mattress.

Figure 4:
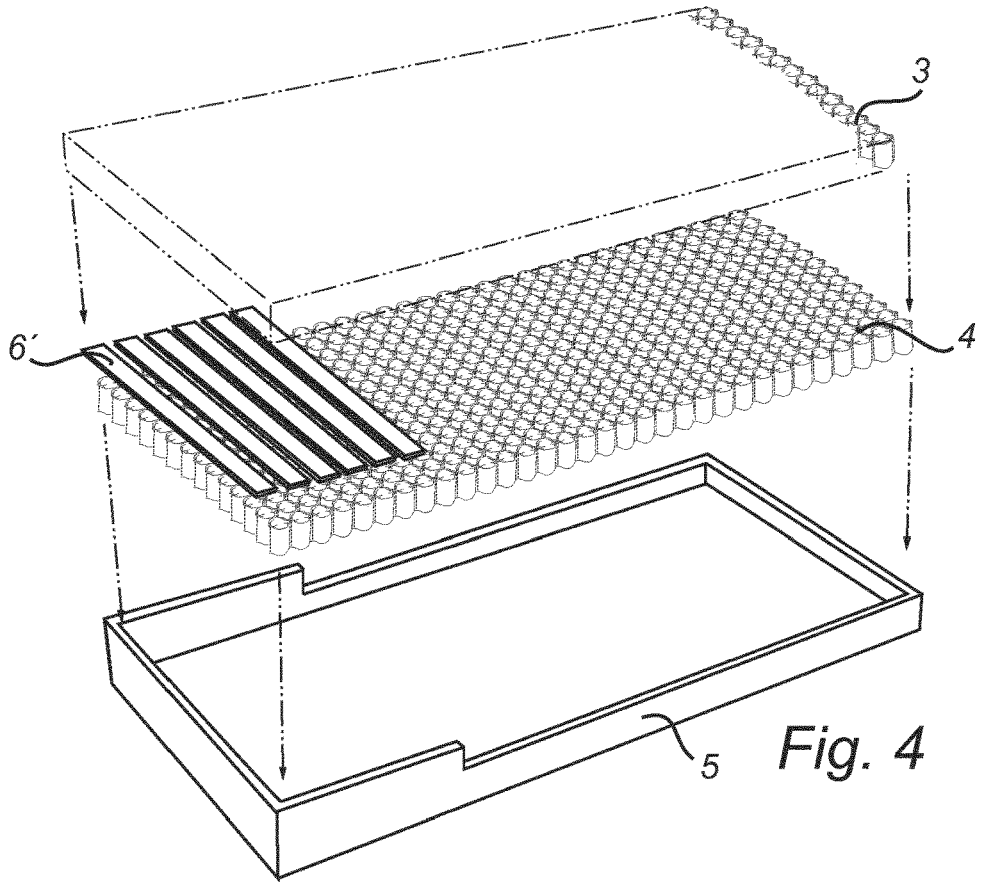
FIG. 4 shows a schematic exploded perspective view of a bed arrangement according to yet another embodiment of the present invention.

In another embodiment, illustrated in FIG. 4, the supporting layer is attached to a bed frame, in the same way as in the embodiment discussed in relation to FIG. 2. In this embodiment, the support layer 6' is formed of pliable/flexible and preferably non-elastic elements, flexible bands, cords, or the like. Alternatively, a flexible fabric or the like may be used instead.

Figure 12:
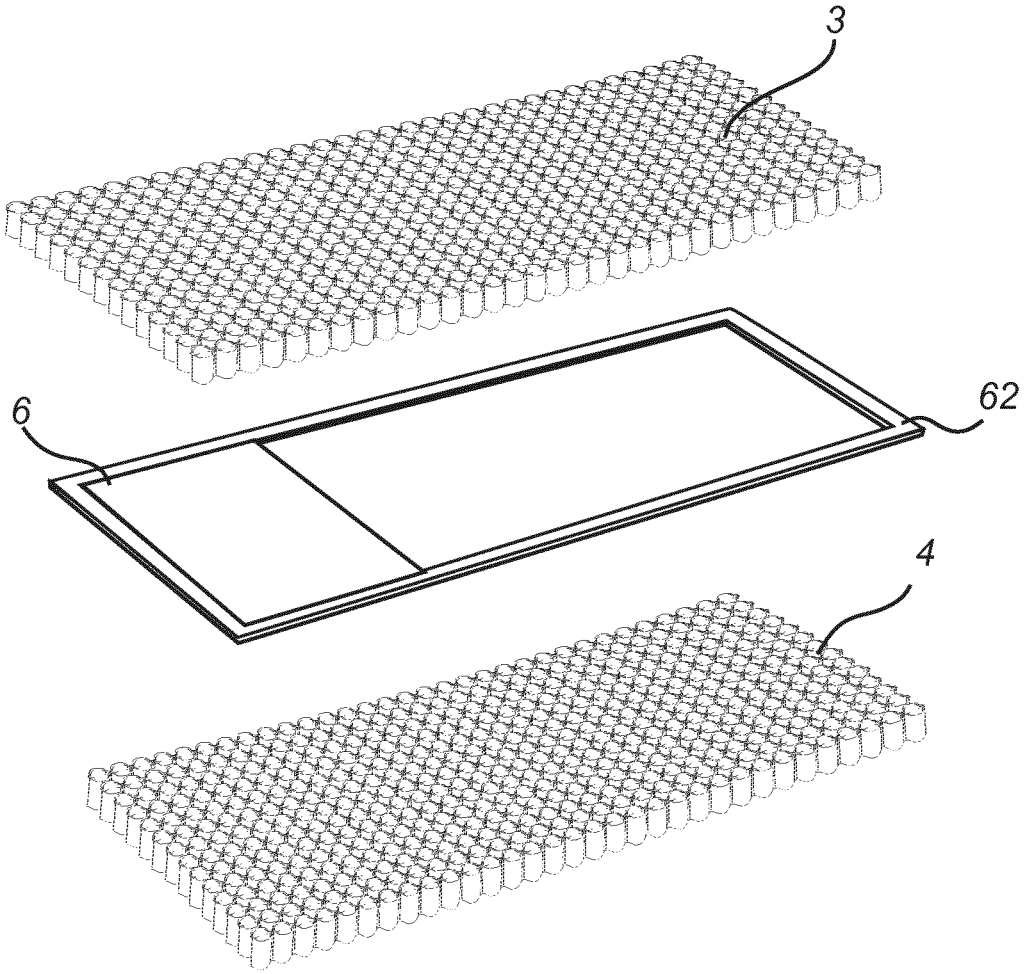
FIG. 12 shows a schematic exploded perspective view of a bed arrangement according to a further embodiment of the present invention.

Further, the support layer may be connected to a support structure arranged entirely between the upper mattress 3 and the lower mattress 4. Such an embodiment is illustrated in FIG. 12. Here, the support layer is connected to a rigid support frame 62, arranged around the perimeter of the upper mattress. The support layer may, as in the previous examples, be a rigid plate, but may alternatively be a flexible fabric, flexible straps or the like.

The upper mattress may be of various types, such as being an inflatable element(s), a resilient foam element(s), a resilient rubber element, and the like. However, preferably the upper mattress comprises a plurality of coil springs, and preferably coil springs individually arranged in separate pockets of a cover material, to define a pocket spring mattress. The lower mattress may also be of various types. The lower mattress may be of the same type as the upper mattress, or of a different type.

Preferably, the lower mattress is a pocket spring mattress, comprising a plurality of coil springs arranged in pockets. Most preferably, the pocket spring mattress comprises a plurality of parallel strings interconnected side by side, each string comprising a plurality of continuous casings and each casing comprising a coil spring, wherein expansion of the mattress into the expanded state occurs in a least one of a direction being parallel to the strings and a direction being perpendicular to the strings. Each string is preferably formed by continuous cover material, and the separation between adjacent pockets being formed by lateral separation joints. These separation joints, as well as longitudinal joints, may be formed through any form of adhesive bonding, welding, stapling, sewing, or any combination thereof. In a preferred embodiment, welding is used. Coil springs of many different sizes could be used in conjunction with the present invention, and in principle any desired spring size, large or small, may be used. Preferably, however, the coil springs have a diameter in the range 2-10 cm, and preferably in the range 4-8 cm, such as 6 cm. In addition, the coil springs are preferably manufactured from helically coiled wires. The springs preferably comprise at least three turns, and preferably fewer than 10 turns. Moreover they are advantageously made of spiral wire with a thickness in the range 0.5-3.0 mm, preferably a wire thickness in the range 1.25-2.50 mm. Preferably the springs are slightly spool-shaped, that is with smaller turns at the top and bottom. Mattresses of these types are per se known.

Figure 5A:
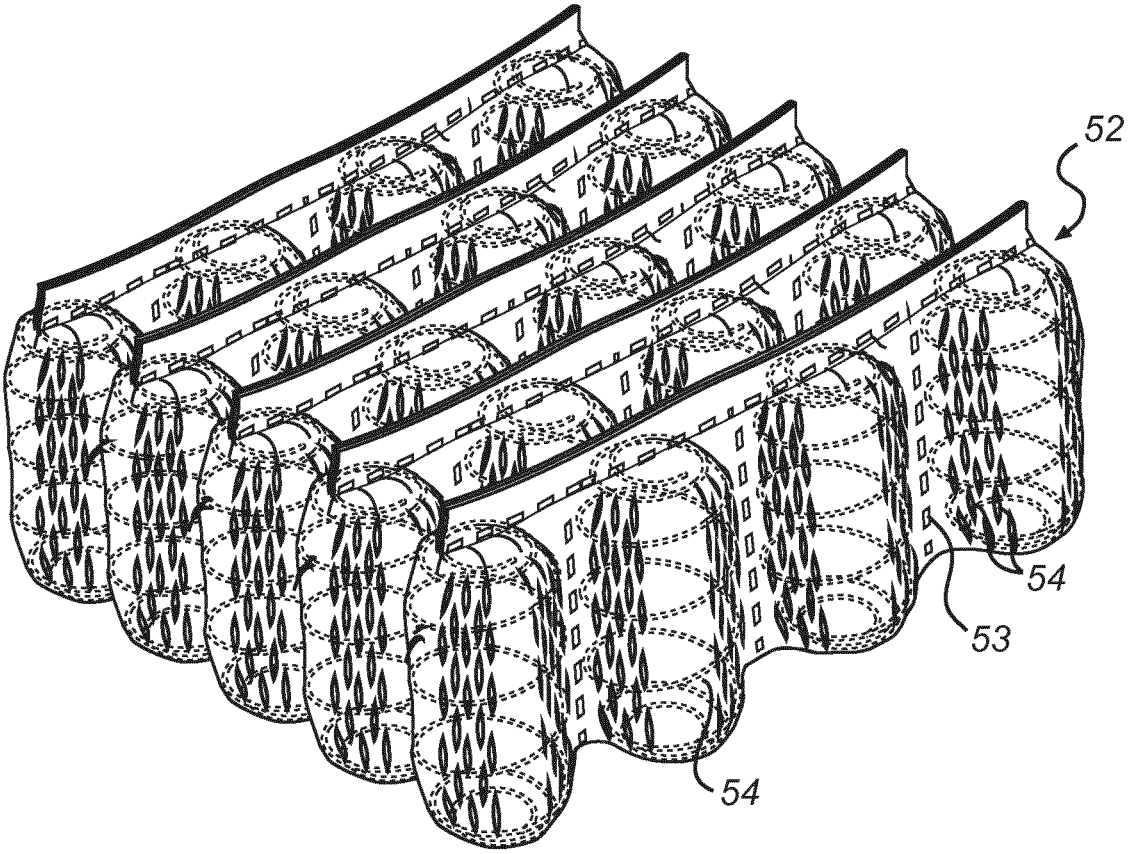
FIGS. 5*a* and 5*b* show an embodiment of the lower mattress, illustrated in a perspective side view and a top view, respectively.
Figure 5B:
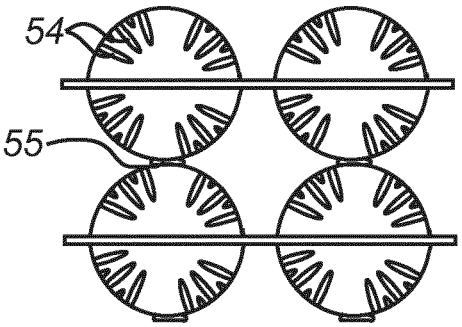

One mattress type which is suitable for use as the lower mattress is the one disclosed in U.S. Pat. No. 8,176,589, by the same applicant, said document hereby incorporated in its entirety by reference. Such a mattress is illustrated in FIGS. 5*a* and 5*b*. This pocket spring mattress comprises pockets 51 arranged in strings 52. In each pocket there is a coil spring. Each string is made of a continuous cover material, and the pockets are formed by separation joints 53, e.g. formed by welding. The strings are connected to each other in parallel in a side-by-side arrangement, by connections 55. These connections may be formed by adhesive, but may alternatively be effected by welding, Velcro or the like. Further, the pockets are provided with a plurality of stretch openings 54, providing a net-like surface structure. This allows the strings to be separated from each other.

Figure 6:
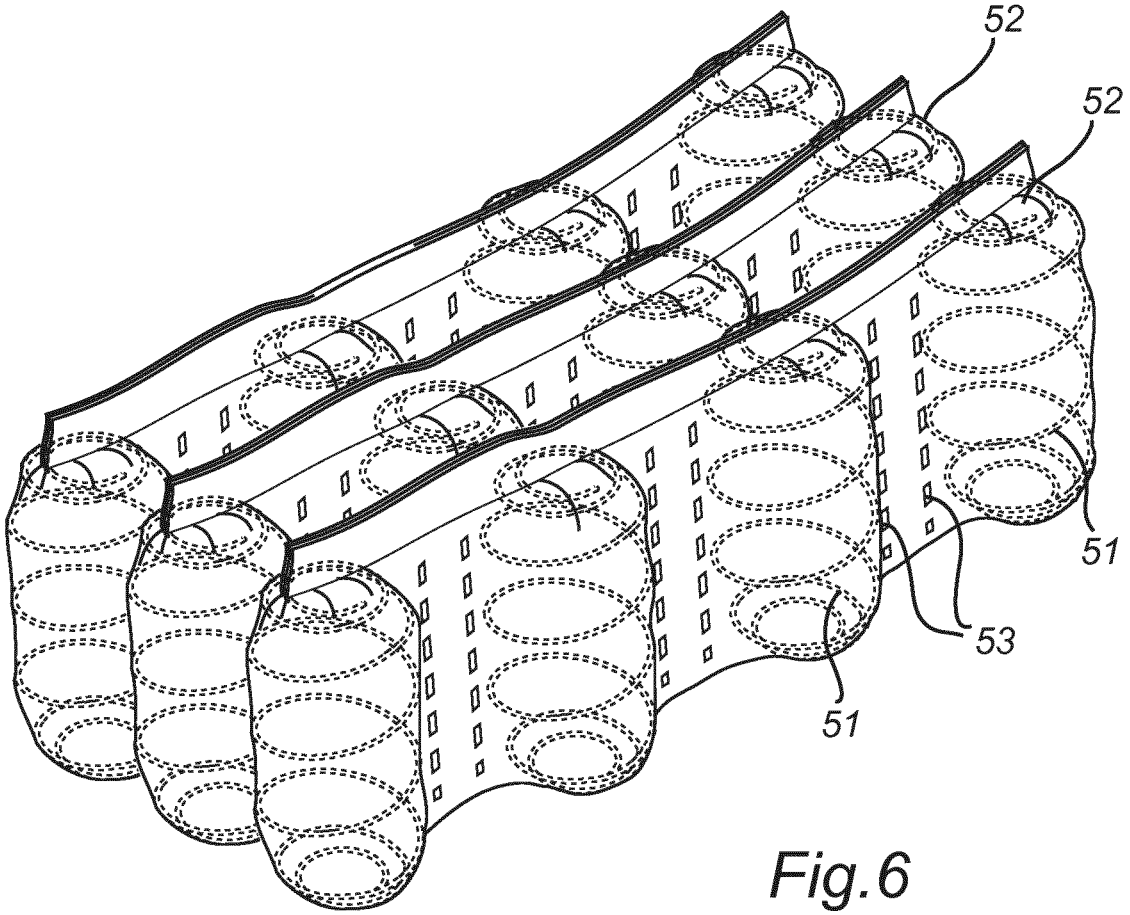
FIG. 6 shows another embodiment of the lower mattress, illustrated in a perspective side view.

Another mattress type which is suitable for use as the lower mattress is the one disclosed in U.S. Pat. No. 7,048,263, also by the same applicant, said document also being incorporated by reference in its entirety. Such a mattress is illustrated in FIG. 6. This mattress have the same general structure as in the previous example, with coil springs being arranged in pockets 51, forming strings 52 that are connected to each other in parallel. However, in this embodiment an increased separation distance between the pockets/springs in each string is provided. This may be effected by provision of two spaced apart separation joints 53', or alternatively by using wide separation joints or the like. Hereby, a separation distance is formed between adjacent springs/pockets within each string, allowing the mattress to be expanded and contracted in the direction of the strings.

Figure 7A:
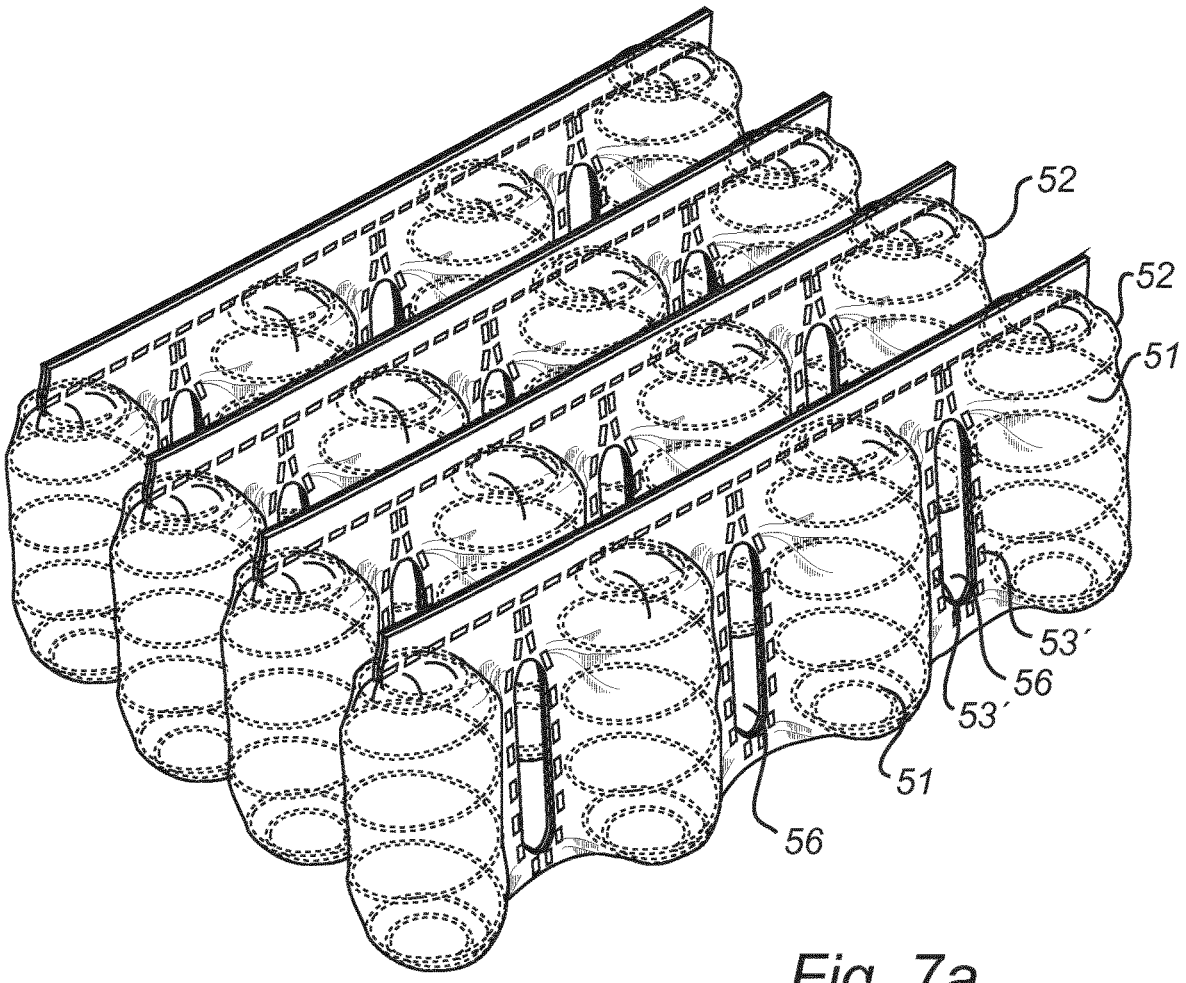
FIGS. 7*a-c* show still another embodiment of the lower mattress, illustrated in a perspective side view and a side views, respectively, where FIGS. 7*a* and *c* illustrates the mattress in an expanded state
Figure 7B:
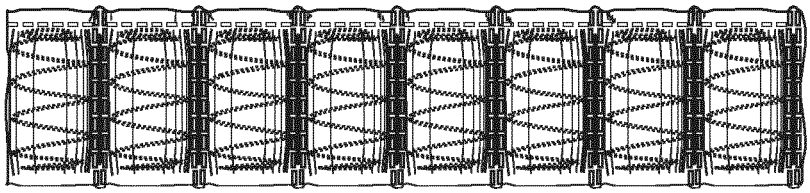
Figure 7C:
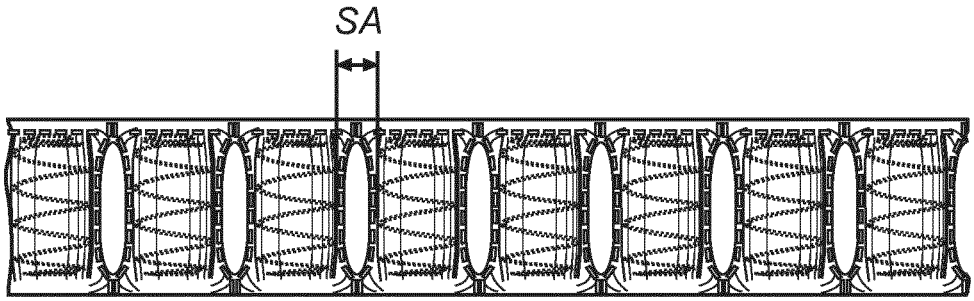

Still another mattress type which is suitable for use as the lower mattress is the one disclosed in US 2007/124865, also by the same applicant, said document also being incorporated by reference in its entirety. Such a mattress is illustrated in FIG. 7. This mattress have the same general structure as in the previous example, with coil springs being arranged in pockets 51, forming strings 52 that are connected to each other in parallel. Further, there is provided an increased separation distance between the pockets/springs in each string is provided, effected by provision of two spaced apart separation joints 53' or the like. To further increase the flexibility of the strings, slit openings 56 are provided between pockets, and between the separation joints 53'. The slit openings are preferably enclosed within the material, without any open ends. FIG. 7*b* illustrate this mattress in a contracted state, whereas FIG. 7*c* illustrate the same mattress in an expanded state.

The lower mattress further preferably comprises at least one elastic element extending between said moveable side and said opposite side of the lower mattress, wherein the at least one elastic element is arranged to provide a contraction force to bring the lower mattress to the contracted state. Hereby, the lower mattress will resume a contracted state when no exterior force is applied. This simplifies operation of the mattress and also ensures that the distribution of springs in the lower mattress remains uniform also in every intermediate state, between the expanded state and the contracted state. The elastic element may e.g. a band, string, cord or the like of an elastic material. Preferably, a plurality of elastic elements is provided, being distributed over or within the lower mattress. Further, it is preferred that each elastic element is connected to the lower mattress at a plurality of distributed connection points. In case of a pocket spring mattress, it is preferred that each elastic element is connected to a plurality of pockets, and preferably to each pocket it is in contact with. Specifically, such elastic elements may be combined with any of the pocket spring mattress types discussed above in relation to FIGS. 5-7.

In FIG. 8, some alternative ways of providing such elastic elements 57 are illustrated.

Figure 8A:
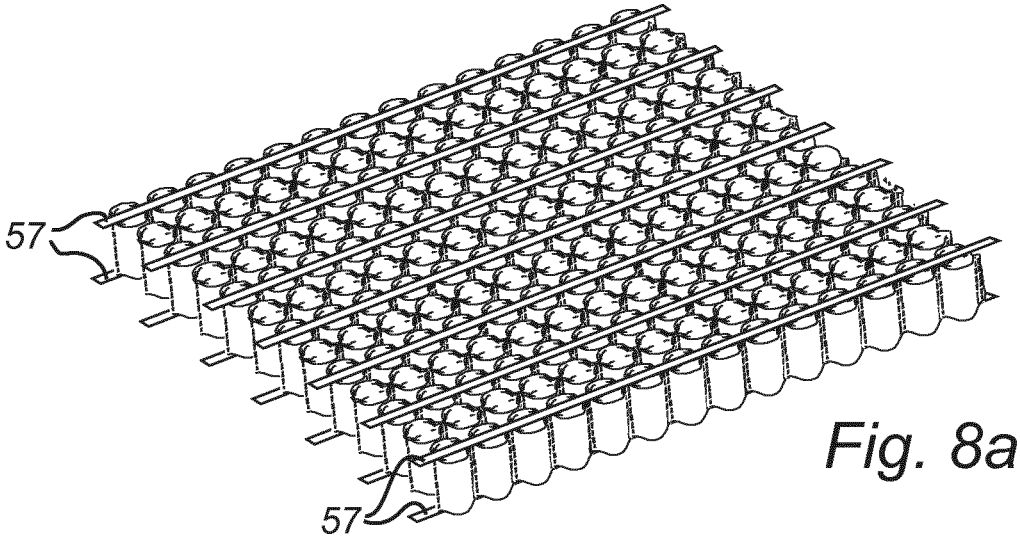
FIGS. 8 *a-f* illustrate various embodiments of the lower mattress having elastic elements or the like to retract the mattress to a contracted state or to expand the mattress to an expanded state.

In FIG. 8*a*, a pocket spring mattress is illustrated in which elastic elements 57 are arranged on the top and bottom of the lower mattress. In the illustrated example, elastic elements are arranged both on the top and the bottom of the lower mattress, but alternatively elastic elements may be arranged only at the top or only at the bottom. Further, the elastic elements are here arranged aligned with the strings. However, alternatively or additionally, elastic elements may also be arranged perpendicular to the string direction. Further, in this example, elastic elements are arranged along each string, but fewer elastic elements may also be used. The elastic elements are preferably connected at to the strings at a plurality of positions, such as to every pocket it comes into contact with.

Figure 8B:
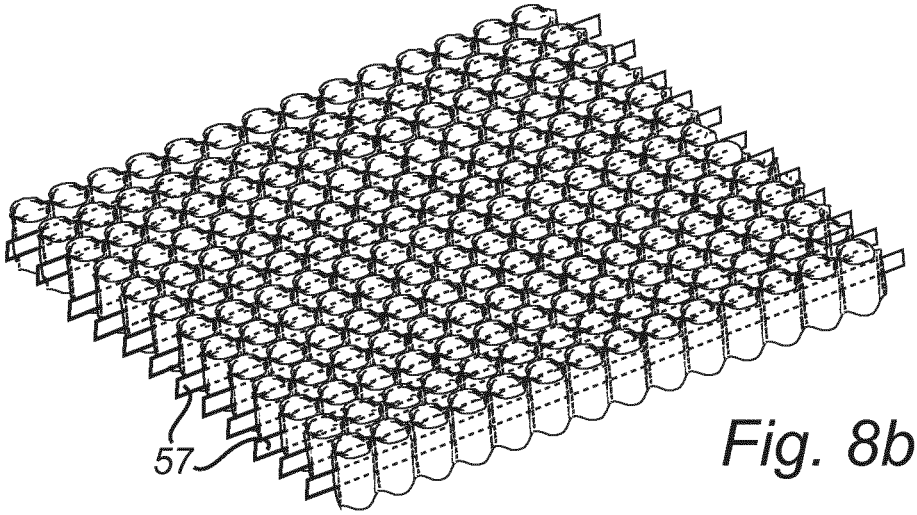

Alternatively or additionally, the elastic elements 57 may be arranged on the sides of the mattress, and in between the strings. Such an embodiment is illustrated in FIG. 8*b*. In this embodiment, elastic elements are provided between each pair of strings. Again, fewer elastic elements may be used, and an example of such an embodiment is illustrated in FIG. 8*c*.

Figure 8C:
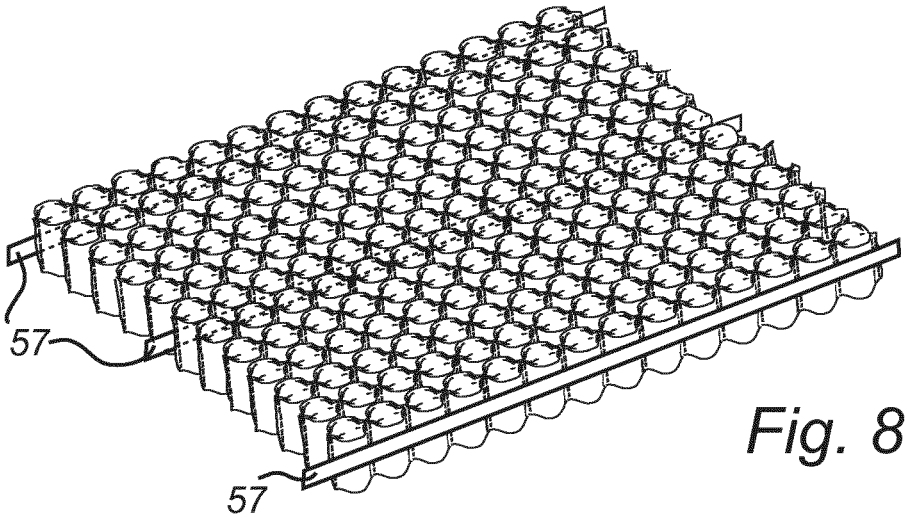
Figure 8D:
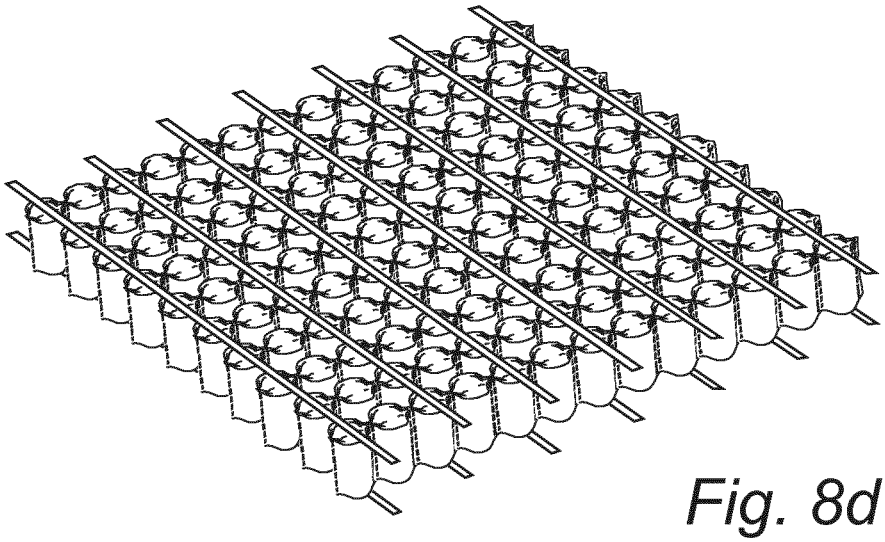

In the embodiments illustrated in FIGS. 8*a-c*, the elastic elements 57 are arranged in parallel with the strings of the mattress. However, the contraction and expansion of the mattress may, as has already been discussed in the foregoing, occur in a direction perpendicular to the string direction. In such a mattress, the elastic elements may instead be arranged with an orientation perpendicular to the string direction. Such an embodiments is illustrated in FIG. 8*d*.

Figure 8E:
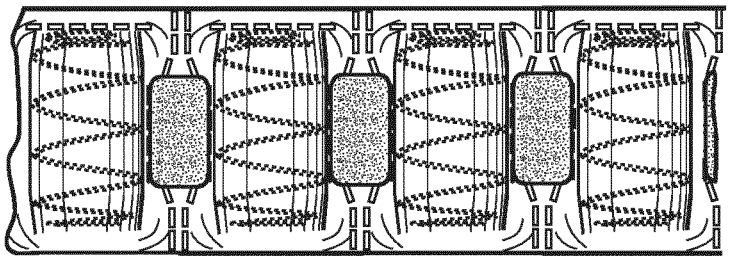

In the embodiments discussed with reference to FIGS. 8*a-d*, the elastic elements are arranged to exert a force to bring the mattress to a contracted state. However, the elastic elements may instead be arranged to exert a force to bring the mattress to an expanded state. Such an embodiment is illustrated in FIG. 8*e*. Here, the elastic elements 57' may be formed of an elastic compressible material, such as latex or polyether, and arranged to be compressed between the springs when the mattress is contracted, and thereby providing a force to expand the mattress again when the contraction force is removed. In the illustrative example of FIG. 8*e*, the elastic compressible material is arranged between adjacent springs within the same string/row of the mattress. However, additionally or alternatively, the elastic compressible material may be arranged between adjacent springs within neighboring strings/rows, i.e. arranged between adjacent strings/rows, rather than being in-line with the strings/rows.

Figure 8F:
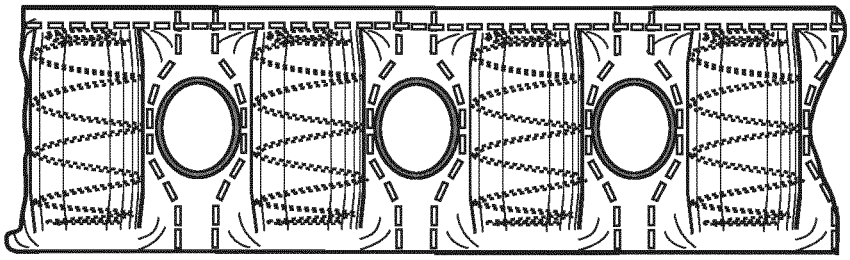
Figure 9A:
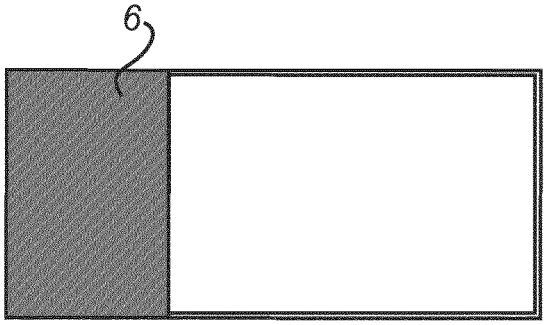
FIGS. 9 *a-e* illustrate various embodiments where the supporting layer(s) are arranged at various parts of the mattress arrangement.
Figure 9B:
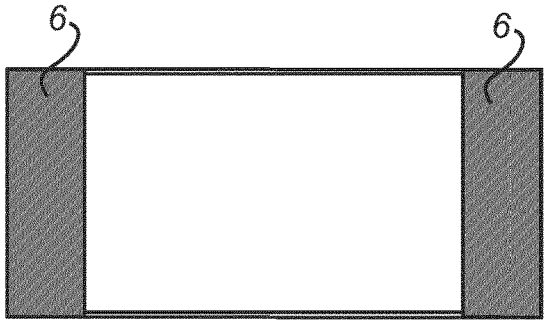
Figure 9C:
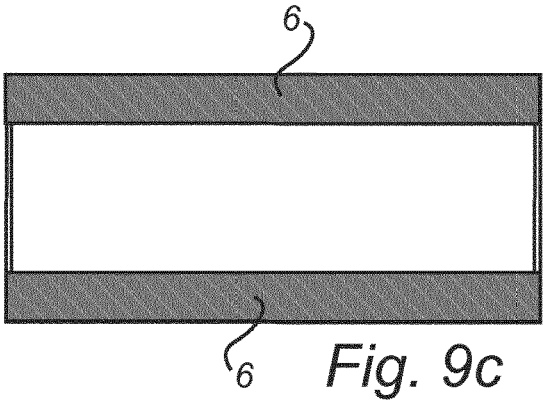
Figure 9D:
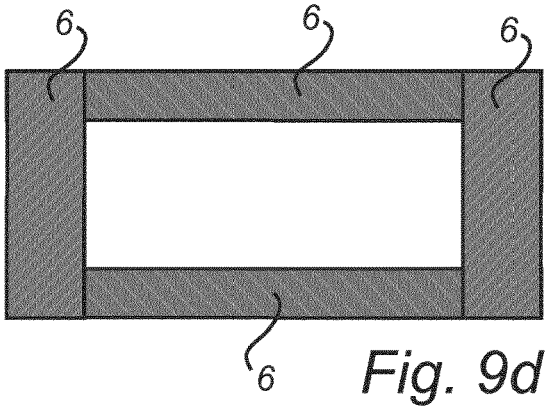
Figure 9E:
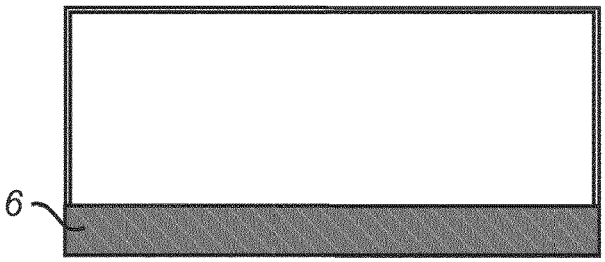

Further, other types of elements may also be used to bring the mattress to an expanded and/or contracted state. For example, inflatable tubes 57", cushions or the like may be arranged between the springs, as is illustrated in FIG. 8*f*. By inflating the tubes 57", the mattress will be brought to an expanded state, and by deflating the tubes, and evacuating the air from them, the mattress will be brought to a contracted state. Thus, this pneumatic principle and such inflatable elements may be used to provide that the mattress resumes a contracted and/or expanded state when an external force is lowered. However, it may also be used to replace other arrangements to move the mattress from a contracted state to an expanded state, and vice versa, and thus be used as a sole means for effecting such state transition.

In the illustrative example of FIG. 8*f*, the inflatable elements extend in a direction perpendicular to the strings/rows of the mattress, and are arranged between adjacent springs within the same string/row. However, additionally or alternatively, the inflatable elements may extend in a direction parallel to the strings/rows, so that the inflatable elements are arranged between adjacent springs within neighboring strings, i.e. arranged between adjacent strings/rows.

In the above-discussed embodiments, the support layer has been arranged at the foot end of the bed arrangement. In this area, there is normally anyway no need for firmness adjustments. Further, in a bed, this part of the mattress arrangement is often used also for sitting, and the increased stability provided by the support layer improves the sitting comfort.

However, additionally or alternatively, the support layer may be arranged along the long sides of the bed arrangement. Again, this would not impair the sleeping comfort, since the outer edges are normally not used when sleeping. On the contrary, the increased stability towards the edges may often be beneficial, since it again improves the comfort when sitting on the side of the mattress arrangement, and also lowers the risk of accidentally falling out of the bed. Arrangement of the support layer along one or both long sides of the mattress arrangement would also be advantageous when using the mattress arrangement in sofas, davenports and the like.

In FIGS. 9 *a-e*, various arrangements of the support layer are schematically illustrated. In FIG. 9*a*, a support layer 6 is arranged at the foot end of the bed arrangement, as in the previously discussed examples. In FIG. 9*b*, a support layer 6 is arranged both at the foot end and at the head end, thereby enabling movement of the lower mattress at both ends. In FIG. 9*c*, support layers 6 are arranged at both long sides of the bed arrangement, allowing the lower mattress to expand and contract in the width direction. In FIG. 9*d*, a combination of the embodiments of FIGS. 9*b* and 9*c* is shown, allowing the lower mattress to expand and contract in both the width and length direction. Finally, FIG. 9*e* illustrate an embodiment in which a support layer 6 is arranged solely at one long side of the bed arrangement, allowing the opposite end of the lower mattress to be fixed.

Further, the mattress arrangement preferably comprises a pulling or pushing arrangement connected to the at least one moveable side of the lower mattress, to provide a pulling or pushing force to bring the lower mattress to the expanded state. The pulling arrangement may be one or several ropes, strings or the like connected to a side of the lower mattress or within the lower mattress. Such an arrangement is very cost efficient, and is in particular suitable for manual operation. The ropes/strings may e.g. be locked in a suitable pulled out position by a locking arrangement, be tied together, or in any other way secured. However, the ropes/strings may also be operated by an electric motor or the like. Further, the moveable side of the lower mattress may be connected to a rigid pulling or pushing element, which may be displaced automatically, by an electric motor or the like, or manually, by a screw arrangement or the like. For example, a lead screw or translation screw may be used. A knob, wheel or any other type of handle may then be manually rotated, thereby rotating the screw, resulting in a corresponding displacement of the rigid pulling or pushing element.

Some embodiments of such pulling arrangements will be illustrated in the following.

Figure 10A:
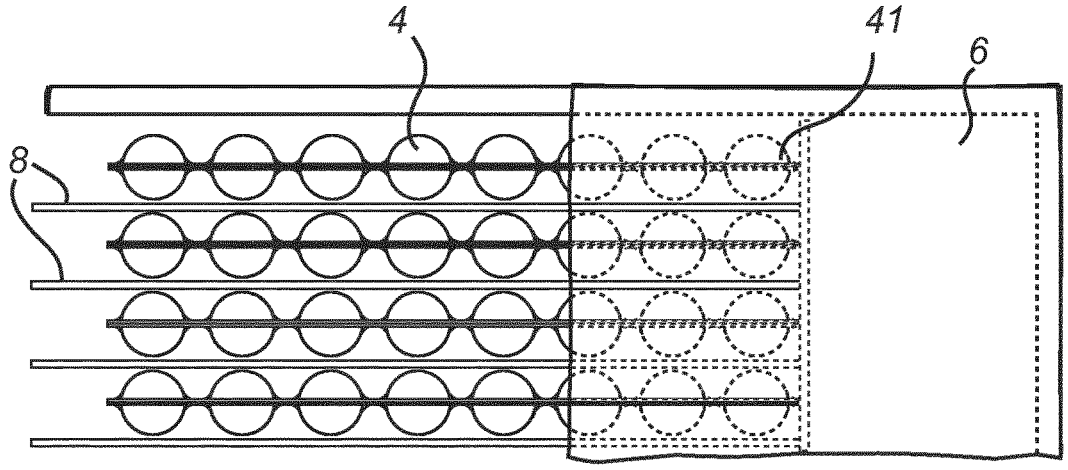
FIGS. 10 *a-d* illustrate various embodiments of pulling arrangement for bringing the lower mattress to an expanded state.

In FIG. 10*a*, maneuvering elements 8, e.g. flexible elements, such as ropes or strings, or more rigid elements, such as rods or the like, are shown, which are attached to the moveable side 41 of the lower mattress 4, being arranged beneath the support layer 6. The maneuvering elements 8 extend within or beneath the lower mattress, and are accessible from the opposite side. By pulling the maneuvering elements 8, the mattress will be contracted, and the maneuvering elements may be fastened in any suitable way to lock the mattress in the desired intermediate or contracted state. The movable side of the mattress may be connected to resilient elements (not shown), such as springs, acting to bring the mattress back to an expanded state. Alternatively or additionally, the maneuvering elements 8 may be relatively rigid, and usable instead or additionally for pushing the movable side away, towards an expanded state. In this case, the mattress may comprise elastic elements, as discussed in the foregoing, acting to bring the lower mattress into a contracted state.

Figure 10B:
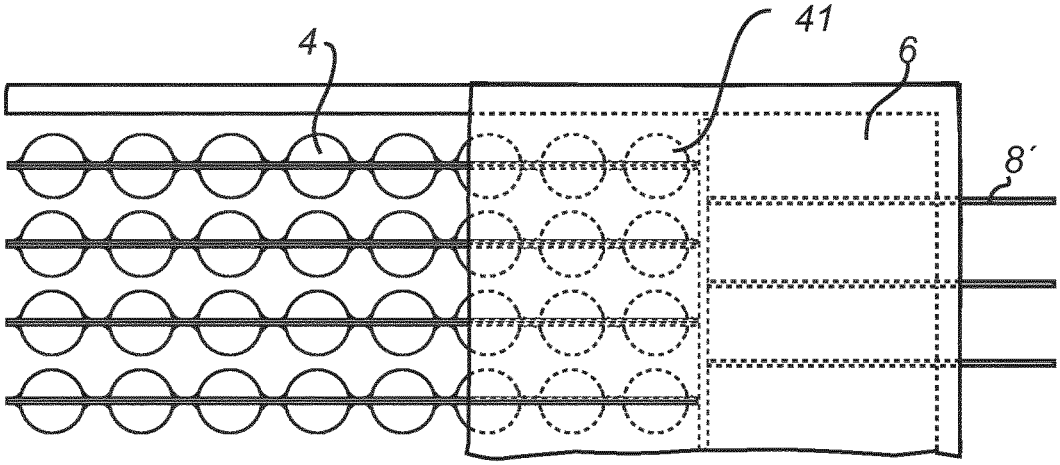

In FIG. 10*b*, a similar arrangement is shown. Here, the maneuvering elements 8' are also connected to the movable side 41 of the lower mattress, but are instead displaced from the same side, and by pulling the maneuvering elements inwardly, the mattress is compressed, and by pulling the maneuvering elements, the mattress is expanded.

Figure 10C:
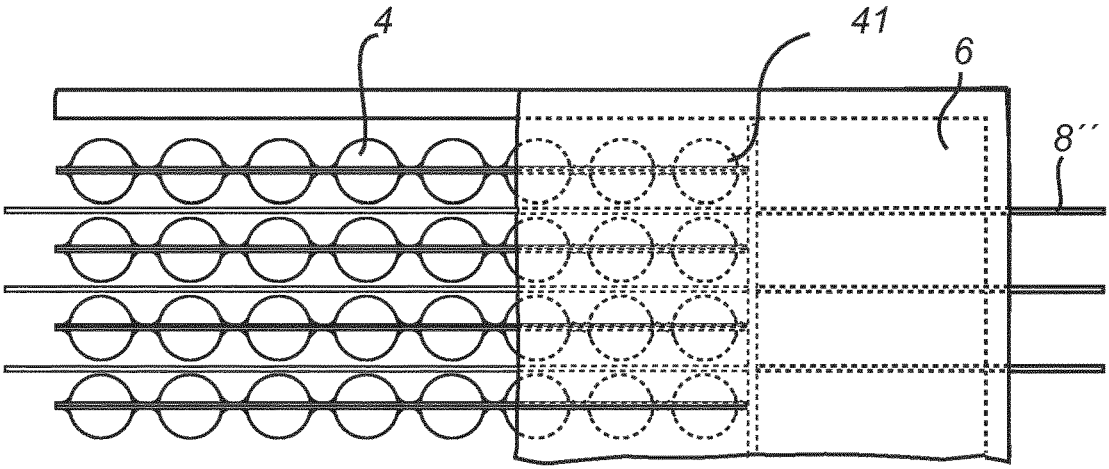

In FIG. 10*c*, an arrangement is illustrated with maneuvering elements 8", such as ropes or strings or the like extending in both directions from the moveable end 41 of the lower mattress 4, and being accessible from both ends. This arrangement may be used both to pull the moveable end to a contracted state, as in the embodiment of FIG. 10*a*, and to pull the moveable end back to an expanded state from the other side. In such there may not be any need for any the elastic or resilient elements acting to bring the lower mattress into a contracted or expanded resting position.

Figure 10D:
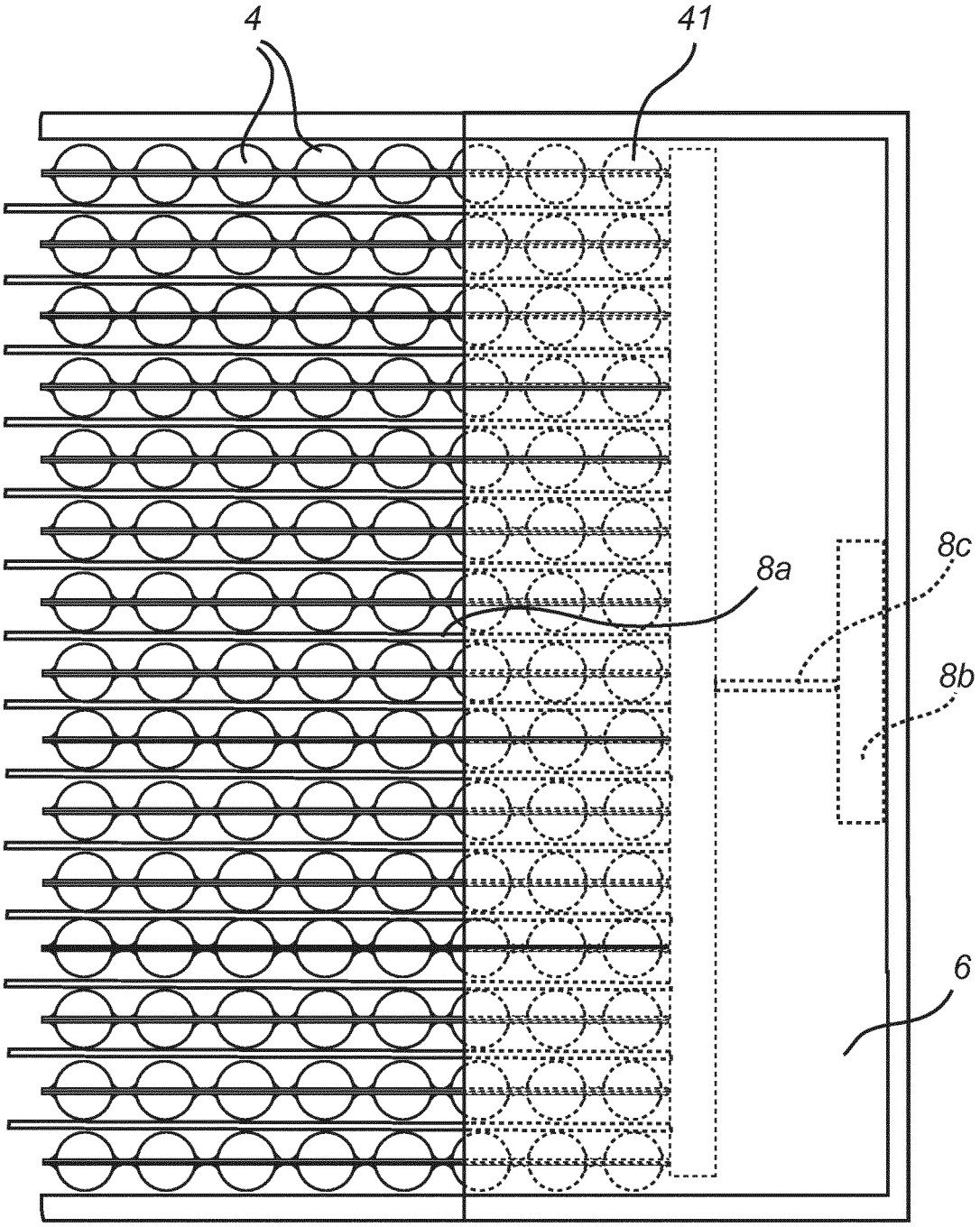

In FIG. 10*d*, an automated arrangement is illustrated. Here, the moveable end 41 is connected to a rigid side element 8*a*, which in turn is connected, via a displacement arm 8*c*, to an electric displacement arrangement, such as an electric motor, an electric pump 8*b* or the like.

Figure 11:
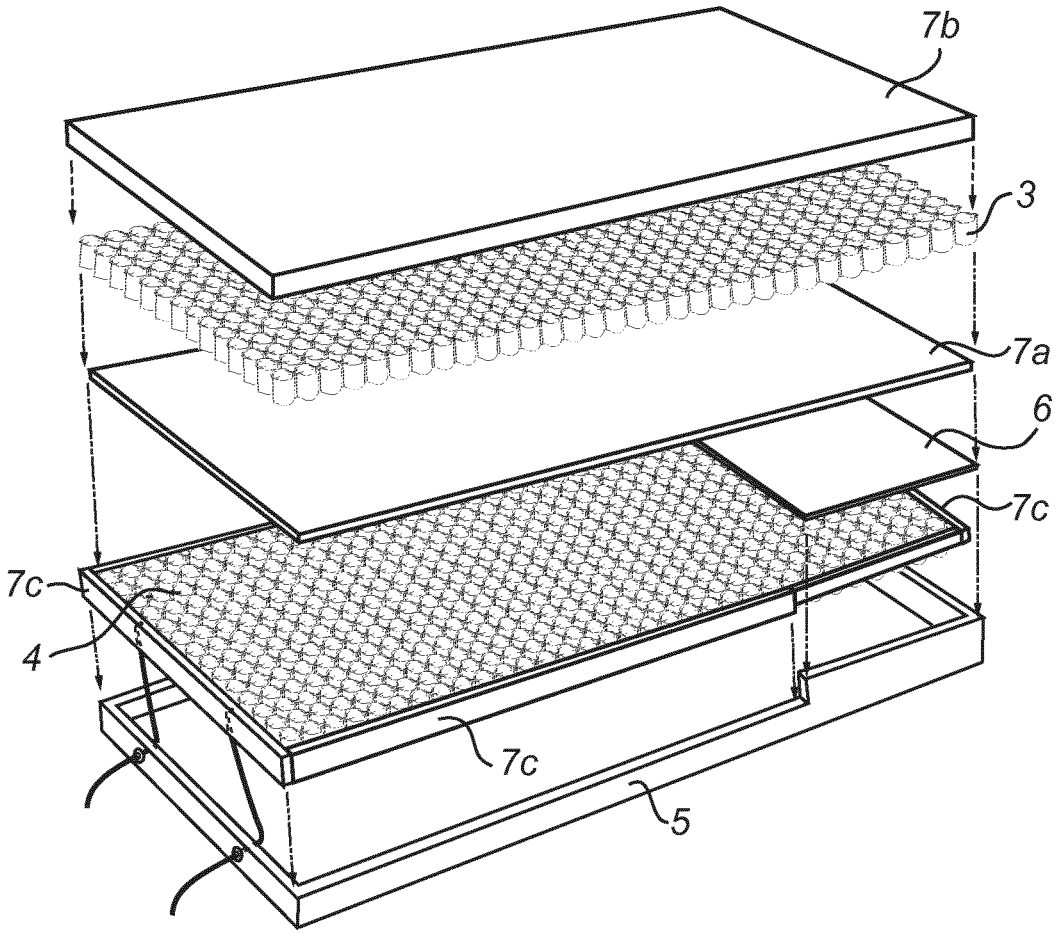
FIG. 11 shows a schematic exploded perspective view of a bed arrangement according to one embodiment of the present invention having additional layers.

In addition to the upper and lower mattresses 3 and 4, and the frame 5, additional mattress or padding layers may be provided. One such example is schematically illustrated in FIG. 11, where an upper surface padding 7*b* is provided, an intermediate mattress or padding layer 7*a* is provided between the upper and lower mattresses, and where padding or mattress sides 7*c* are provided around the lower mattress. Fewer or additional padding or mattress layers are naturally also feasible.

The person skilled in the art realizes that the present invention by no means is limited to the preferred embodiments described above. On the contrary, many modifications and variations are possible within the scope of the appended claims. For instance, both the upper and lower mattress may be of other mattress types than pocket spring mattress, such as resilient elements formed by foam, rubber, coil springs, inflatable elements, and the like. Further, the lower mattress may be contracted and expanded in various directions, and the support layer may be held in place in different ways. Further, the firmness of the mattress arrangement may be controlled either manually or electrically aided. Such obvious variants must be considered to be comprised by the invention as defined by the appended claims.

The invention claimed is:

1. A mattress arrangement, such as a bed arrangement, comprising:

an upper mattress;

a lower mattress being arranged beneath said upper mattress;

a support layer arranged between the upper mattress and the lower mattress, to partly support the upper mattress, said support layer being arranged only partly to support the upper mattress, such that a greater part of a lower surface of the upper mattress remains unsupported by the support layer, said greater part of the lower surface of the upper mattress instead being supported directly by the lower mattress;

wherein the lower mattress has a variable extension in a length direction of the lower mattress and/or a width direction of the lower mattress, such that at least one side of the lower mattress is an at least one moveable side that is moveable in the length direction of the lower mattress and/or the width direction of the lower mattress in relation to an opposite side of the lower mattress, such that the lower mattress is expandable into an expanded state, having a lower firmness, and compressible into a contracted state, having a higher firmness; and wherein said support layer is arranged overlying said at least one moveable side of the lower mattress to form at least one compartment beneath the upper mattress, said at least one compartment being at least partly empty when the lower mattress is in the contracted state and at least partly filled when the lower mattress is in the expanded state.

2. The mattress arrangement of claim 1, wherein the lower mattress has the variable extension in at least the length direction of the lower mattress.

3. The mattress arrangement of claim 1, wherein at least a side arranged at a foot-end of the lower mattress is moveable in relation to a side arranged at a head end of the lower mattress.

4. The mattress arrangement of claim 3, wherein the side arranged at the head end of the lower mattress is fixed.

5. The mattress arrangement of claim 1, wherein the lower mattress in its expanded state has outer dimensions corresponding to the outer dimensions of the upper mattress.

6. The mattress arrangement of claim 1, wherein the lower mattress may further assume at least one, and preferably a plurality, of intermediate states, between said expanded state and said contracted state.

7. The mattress arrangement of claim 1, wherein the lower mattress is a pocket spring mattress, comprising a plurality of coil springs arranged in pockets.

8. The mattress arrangement of claim 7, wherein the pocket spring mattress comprises a plurality of parallel strings interconnected side by side, each string comprising a plurality of continuous casings and each casing comprising a coil spring, wherein expansion of the mattress into the expanded state occurs in a least one of a direction being parallel to the plurality of parallel strings and a direction being perpendicular to the plurality of parallel strings.

9. The mattress arrangement of claim 8, further comprising a pulling or pushing arrangement connected to said at least one side of the lower mattress, to provide a pulling or pushing force to bring the lower mattress to the expanded state.

10. The mattress arrangement of claim 1, wherein the lower mattress comprises at least one elastic element extending between said at least one moveable side of the lower mattress and said opposite side of the lower mattress, said at least one elastic element being arranged to provide a contraction force to bring the lower mattress to the contracted state.

11. The mattress arrangement of claim 1, further comprising a frame arranged to at least partly accommodate the lower mattress, wherein said support layer is connected to said frame.

* * * * *